US007908138B2

(12) United States Patent
Jin et al.

(10) Patent No.: US 7,908,138 B2
(45) Date of Patent: Mar. 15, 2011

(54) LOW COMPLEXITY NOISE REDUCTION METHOD

(75) Inventors: Gary Qu Jin, Kanata (CA); Dean Morgan, Kanata (CA)

(73) Assignee: Zarlink Semiconductor Inc., Kanata, ON (CA)

( * ) Notice: Subject to any disclaimer, the term of this patent is extended or adjusted under 35 U.S.C. 154(b) by 1253 days.

(21) Appl. No.: 11/463,377

(22) Filed: Aug. 9, 2006

(65) Prior Publication Data

US 2007/0055507 A1 Mar. 8, 2007

Related U.S. Application Data

(60) Provisional application No. 60/707,123, filed on Aug. 10, 2005.

(51) Int. Cl.
*G10L 21/02* (2006.01)

(52) U.S. Cl. ..... 704/226; 381/94.3; 381/94.1; 704/225; 704/227; 704/228; 704/233

(58) Field of Classification Search ..... 704/226, 704/225, 227, 228, 233; 381/94.1, 94.3
See application file for complete search history.

(56) References Cited

U.S. PATENT DOCUMENTS 6,604,071 B1 * 8/2003 Cox et al. ..... 704/225
2002/0002455 A1 1/2002 Accardi et al.

FOREIGN PATENT DOCUMENTS

WO 97/10586 A 3/1997
WO WO 9710586 A1 * 3/1997
WO 2005/114656 A 12/2005

* cited by examiner

*Primary Examiner* — Vivian Chin
*Assistant Examiner* — Paul Kim
(74) *Attorney, Agent, or Firm* — Marks & Clerk; Richard J. Mitchell

(57) ABSTRACT

To reduce noise in an input signal that may contain speech, first an estimate of the noise level in the signal is obtained. The level of the input signal is then compared with the noise level estimate signal to determine whether speech is dominant. Less aggressive noise reduction is applied to the input signal when speech is dominant than when only noise is present.

14 Claims, 2 Drawing Sheets

LOW COMPLEXITY NOISE REDUCTION METHOD

CROSS REFERENCE TO RELATED APPLICATION

This application claims the benefit under 35 USC 119(e) of U.S. provisional application No. 60/707,123, the contents of which are herein incorporated by reference.

FIELD OF INVENTION

This invention relates to the field of digital signal processing, and in particular to a method of reducing noise in a signal that may contain speech, for example in telephony, when operating in high noise environments.

BACKGROUND OF THE INVENTION

Noise cancellation is a crucial feature for acoustic echo cancellers when operating in high noise environments, such as the mobile telephone environment. For example, the ambient noise in an automotive environment is higher than that in other environments due to engine and road noise. Due to the elevated noise level the voice signal can become unintelligible. Under these conditions noise reduction can significantly improve the voice quality of a call.

The most common and effective method for noise reduction is spectral subtraction as described in J S. F. Boll: "Suppression of Acoustic Noise in Speech Using Spectral Subtraction", IEEE Trans. on Acous. Speech and Sig. Proc., 27, 1979. pp. 113-120, the contents of which are herein incorporated by reference. However, the spectral subtraction requires a transform (FFT or DCT are commonly used) to separate speech and background noise in a spectral transform domain. The noise spectrum is subtracted in each spectrum sub-band so that clean speech can be preserved. These transforms require a lot of computation power and are therefore costly to implement.

SUMMARY OF THE INVENTION

In the present invention, noise subtraction is done purely in the time domain so no transforms are required. The invention solves the problem of how to reduce background noise while minimizing the speech distortion. The method can also be applied to any spectral subtraction method where the inventive method can be applied to each sub-spectrum.

The noise reduction method includes accurate noise level measurement both when speech is dominant and not present, and achieves noise reduction without deteriorating the incoming speech. The inventive method can also be applied to any spectral subtraction method where the same implementation can be applied to each individual spectrum sub-band.

In one aspect the invention provides a method of reducing noise in an input signal that may contain speech, comprising obtaining a noise level estimate signal; comparing the level of said input signal with said noise level estimate signal to determine whether speech is dominant; and applying less aggressive noise reduction to said input signal when speech is dominant than when only noise is present.

In a preferred embodiment the noise estimate signal is obtained by accumulating the magnitude of the incoming signal over a predetermined number of samples to obtain an updated noise level signal; comparing the updated noise level signal with an incremented previous noise level estimate signal; and if the updated noise level signal is larger the incremented previous noise level signal, using the updated noise level as the current noise level signal, and if the updated noise level signal is smaller than the incremented previous level estimate signal, decreasing the noise level signal with a large step, whereby the noise level estimate signal has a slow ramp-up speed and a fast ramp-down speed.

In another aspect the invention provides a method of reducing noise in an incoming signal, comprising deriving an estimate of the noise level; detecting the level of the incoming signal; comparing the level of the incoming signal with the estimate of the noise level to determine whether speech is dominant; and applying an appropriate level of noise reduction based on said comparison.

The invention also provides a noise reduction circuit for an input signal that may contain speech, comprising a noise level detector block for producing a noise level estimate output signal; a level detector block for producing a signal level output signal; a parameter selector block for detecting the presence of dominant speech in said input signal based on outputs of said level detector block and said noise level detector block, and setting different noise reduction parameters depending on whether dominant speech is present or not; and a noise reduction block deriving a noise reduced output signal from one or more of the incoming signal, the signal level output signal, and the noise level estimate signal using parameters selected by said parameter selection block.

The invention is particularly applicable to acoustic echo cancellers, where it serves as an extremely low MIP (million instructions per second) noise reduction algorithm. This algorithm provides a simple and effective noise reduction without relying on spectral subtraction and hence removes the need for compute intensive transforms. It finds particular utility in an acoustic echo canceller chip.

BRIEF DESCRIPTION OF THE DRAWINGS

The invention will now be described in more detail, by way of example only, with reference to the accompanying drawings, in which.

DETAILED DESCRIPTION OF THE PREFERRED EMBODIMENTS

Figure 1:
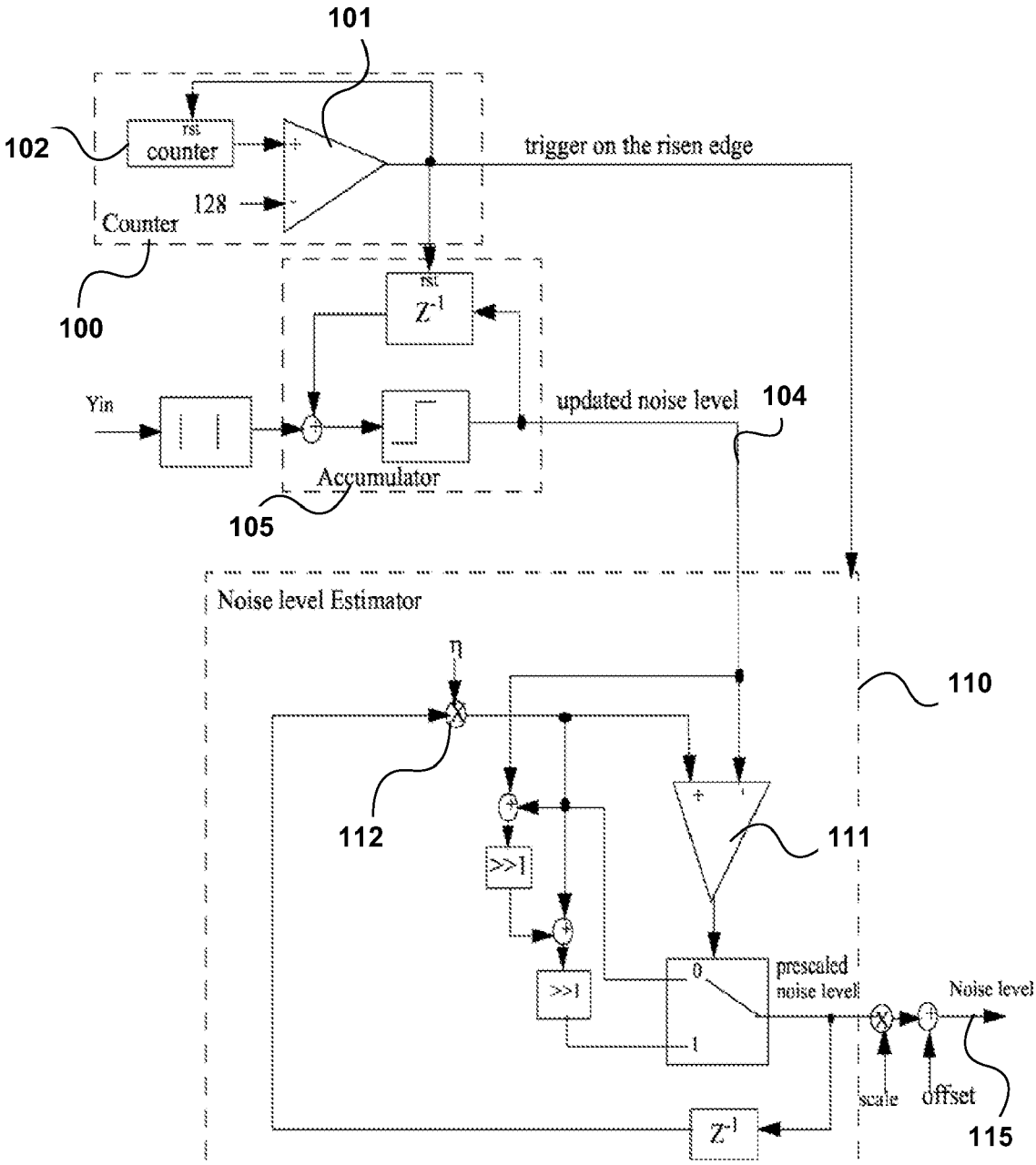
FIG. 1 is a block diagram of a noise level detector.

Detailed of the noise level detector will first be described with reference to FIG. 1, which shows a noise level estimator 110, which is controlled by a sample counter 100 that is updated every 128 samples of the input signal. The counter 100 is operated on the rising edge of the comparator 101, which compares the output of the counter 102 with a threshold, 128 in this case. This rising edge also resets the counter 102 and the accumulator memory 105 for noise level update.

The updated noise level signal 104 is the accumulated result of input signal magnitude |Yin| over 128 samples. Its output is limited from 0 to a saturated number based on number of bits used, which in the case of a 16 bit representation of the input signal would be 32767.

On the rising edge of the comparator 101, when the output of the counter 102 reaches the set threshold value of 128, the updated noise level output from the memory 105 is compared with a new pre-scaled noise level, which is a previous pre-scaled noise level incremented by a small amount. The noise level is scaled by multiplier 112, which has a recommended multiplier factor $\eta=1.002$.

If the newly updated noise level is larger than the new incremented pre-scaled noise level, then the new pre-scaled noise level is used as the current prescaled noise level. If the updated noise level is smaller than the new pre-scaled noise level, then the current noise level is decreased with a large step (0.75*noise_level+0.25*new_calculated_value).

This ensures that the prescaled noise level has slow ramp-up speed and fast ramp-down speed. The objective is to maintain a noise level estimate that will not be affected by incoming speech signals. This ensures that the noise level always traces low level noise during a speech active period.

The final noise level estimate is the scale version of the prescaled noise level (the recommended scale is 0.026) plus an offset. The offset typically varies from 3 to 7 depending on the codec being used for the digital conversion of the speech signal. It also compensates any rounding inaccuracy when the noise level is very small.

Figure 2:
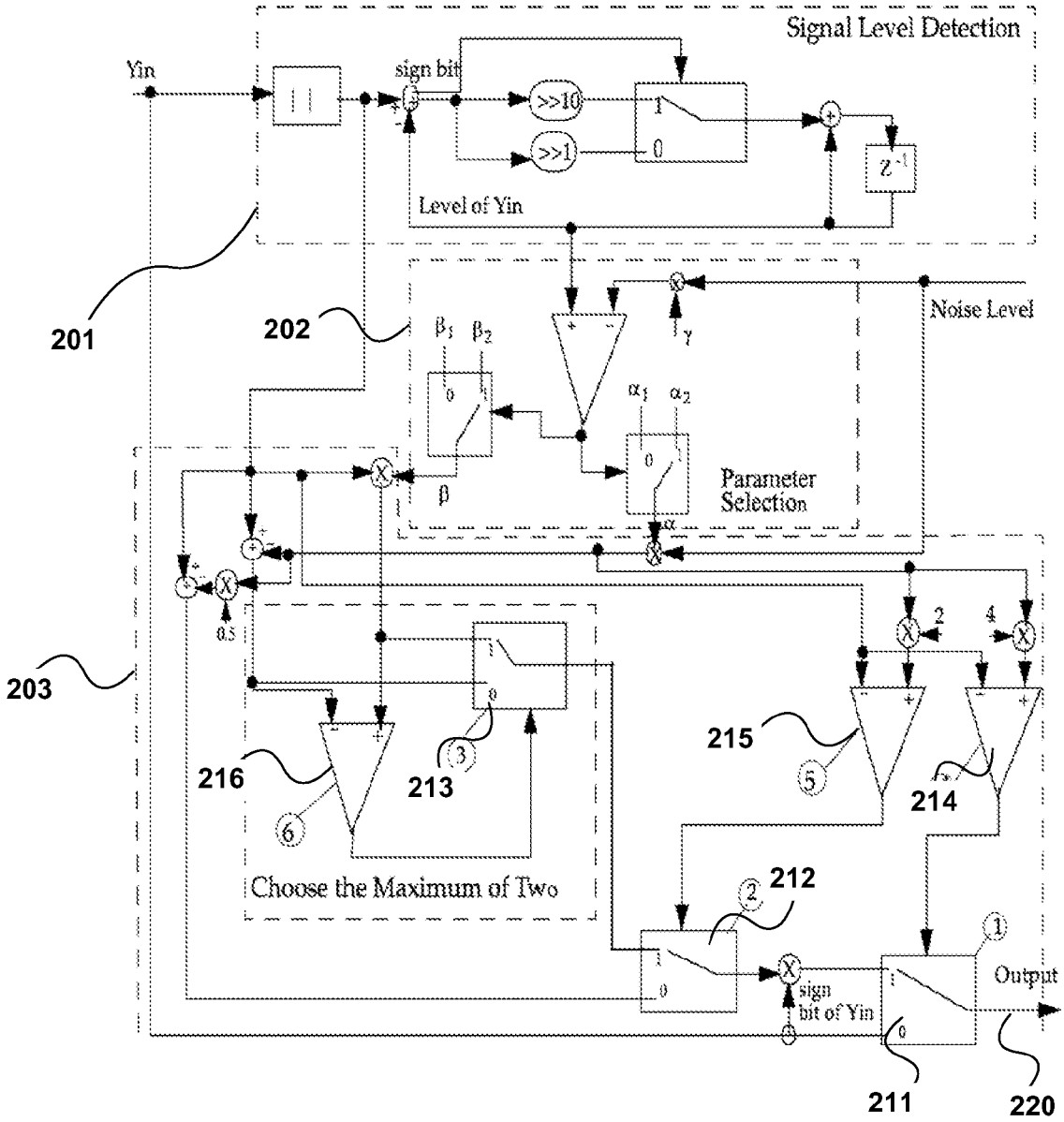
FIG. 2 is a block diagram of a noise reduction unit in accordance with one embodiment of the invention.

The noise reduction unit shown in FIG. 2 consists of three major blocks, namely a signal level detector block 201, a parameter selection block 202, and an output selection block 203. The input variables are the input signal Yin and the noise level estimate signal 115 from the Noise-Level Detector shown in FIG. 1.

The signal level detection blocks tries to find the instantaneous peak level of the signal. It operates as follows:
if |Yin| is smaller than the Level of Yin, the Level of Yin increments with a larger step:

$$\text{Level of Yin} = \frac{(|\text{Yin}| + \text{Level of Yin})}{2}$$

Otherwise the Level of Yin is decreased with a smaller step:

$$\text{Level of Yin} = \frac{(|\text{Yin}| + 1023 \times \text{Level of Yin})}{1024}$$

The parameter selection bock 202 compares the level of Yin with the noise level 115 scaled by a factor $\gamma$, which should be around 2 or 3. If the Level of Yin is larger, it means that speech is dominant and less noise reduction should be applied with parameters $\alpha$ and $\beta$ being $\alpha_2$ and $\beta_2$. The recommended values for $\alpha_2$ and $\alpha_2$ are $\alpha_2$=0.5 and $\beta_2$=0.25. Otherwise, if the Level of Yin is smaller than the scaled noise level, it means that only noise is presented and more aggressive noise reduction should be applied with parameters $\alpha$ and $\beta$ being $\alpha_1$ and $\beta_1$. The recommended values for $\alpha_1$ and $\beta_1$ are $\alpha_1$=1 and $\beta a_1$=0.0625). For better subjective speech quality, a soft parameter switch should be used while $\alpha$ and $\beta$ switched from speech period $\alpha_2$ and $\beta_2$ to non-speech period $\alpha_1$ and $\beta_1$.

The last block 203 is the output selection block. This generates the noise reduced output signal. This signal comes from one of four different values determined by three switch gate selectors 211, 212, and 213 controlled in turn by three comparators 214, 215, and 216. The output selection block functions follows:

When (|Yin|>4$\alpha$Noise Level), the comparator 214 output is low and the switch gate 211 is set at selection 0. This indicates a strong speech signal and the output 220 takes Yin as bypass.

If 2$\alpha$(Noise Level)<|Yin|<4$\alpha$(Noise Level), the comparator 214 output is high and comparator 215 output is low. The switch gate 211 is set at selection 1 and the switch gate 212 is set at selection 0. The output is sign(Yin){|Yin|−0.5$\alpha$(noise Level)}.

If {$\alpha$(Noise Level)+$\beta$|Yin|}<|Yin|<2$\alpha$(Noise Level), the outputs of comparators 214 and 215 are high and comparator 216 output is low. Both switch gates 211 and 212 are set at selection 1 and the switch gate 213 is set at selection 0. The output 220 is sign(Yin){|Yin|−$\alpha$(Noise Level)}.

If |Yin|<{$\alpha$(Noise Level)+$\beta$|Yin|}, the outputs of all comparators (214, 215, and 216 are high and all switch gates (211, 212, and 213) are set at selection 1. The output is $\beta$Yin, which means that the signal will never be reduced below that level.

In this way more aggressive noise reduction is applied when dominant speech is absent.

The described method offers a simple low cost implementation of a noise reduction unit and provides a simple and effective noise level estimator for speech signals, particularly in echo canceller integrated circuits.

We claim:

1. A method of reducing noise in an input signal Yin that may contain speech comprising:

obtaining a noise level estimate signal (Noise Level) of the noise in the input signal Yin; and when (|Yin|>$c_1\alpha$ Noise Level), outputting a signal Yin;

when $c_2\alpha$(Noise Level)<|Yin|<$c_3\alpha$(Noise Level), outputting a signal sign(Yin){|Yin|-$c_4\alpha$(Noise Level)};

when {$\alpha$(Noise Level)+$\beta$|Yin|}<|Yin|<$c_5\alpha$(Noise Level), outputting a signal sign(Yin){|Yin|-$\alpha$(Noise Level)}; and when |Yin|<{$\alpha$(Noise Level)+$\beta$|Yin|}, outputting a signal $\beta$Yin, wherein |Yin| is the magnitude of the input signal Yin, and $c_1$, $c_2$, $c_3$, $c_4$, and $c_5$ are numeric constants, and wherein $\alpha$ and $\beta$ are scaling factors determined by comparing the instantaneous peak level of the input signal with the noise level estimate.

2. A method as claimed in claim 1, wherein the instantaneous peak level of said input signal is compared with said noise level estimate signal multiplied by a scaling factor.

3. A method as claimed in claim 2, wherein said scaling factor is about 2 or 3.

4. A method as claimed in claim 1, wherein $c_1$ is 4, $c_2$ is 2, $c_3$ is 4, $c_4$ is 0.5, and $c_5$ is 2.

5. A method as claimed in claim 1, wherein the noise level estimate signal is obtained by:

(a) accumulating the magnitude of the incoming signal over a predetermined number of samples to obtain an updated noise level signal;

(b) comparing the updated noise level signal with an incremented previous noise level estimate signal; and (c) if the updated noise level signal is larger the incremented previous noise level signal, using the updated noise level as the current noise level signal, and if the updated noise level signal is smaller than the incremented previous level estimate signal, decreasing the noise level signal with a large step, whereby the noise level estimate signal has a slow ramp-up speed and a fast ramp-down speed.

6. A method as claimed in claim 5, wherein said incremented noise level estimate signal comprises the previous noise level estimate signal multiplied by a scaling factor $\eta$.

7. A method as claimed in claim 6, wherein said scaling factor $\eta$ is about 1.002.

8. A method as claimed claim 5, wherein said current level noise signal is multiplied by a scaling factor and provided with an offset to produce a final noise level estimate signal.

9. A method as claimed in claim 1, wherein the incoming signal is divided into a plurality of subbands, and said method is applied to each said subband.

10. A noise reduction circuit for an input signal that may contain speech, comprising:

a noise level detector block for producing a noise level estimate output signal;

a level detector block for producing a signal level output signal;

a parameter selector block for detecting the presence of dominant speech in said input signal based on outputs of said level detector block and said noise level detector block, and setting different noise reduction parameters depending on whether dominant speech is present or not; and a noise reduction block deriving a noise reduced output signal from one or more of the incoming signal, the signal level output signal, and the noise level estimate signal using parameters selected by said parameter selection block, and wherein the noise reduction block implements the following logic to output an output signal:

when $(|Yin|>c_1\alpha\text{Noise Level})$, the output signal is Yin;

when $c_2\alpha(\text{Noise Level})<|Yin|<c_3\alpha(\text{Noise Level})$, the output signal is $\text{sign}(Yin)\{|Yin|-c_4\alpha(\text{Noise Level})\}$;

when $\{\alpha(\text{Noise Level})+\beta|Yin|\}<|Yin|<c_5\alpha(\text{Noise Level})$, the output signal is $\text{sign}(Yin)\{|Yin|-\alpha(\text{Noise Level})\}$; and when $|Yin|<\{\alpha(\text{Noise Level})+\beta|Yin|\}$, the output signal is $\beta Yin$, wherein $|Yin|$ is the magnitude of the input signal Yin, and $c_1$, $c_2$, $c_3$, $c_4$, and $c_5$ are numeric constants, and wherein $\alpha$ and $\beta$ are scaling factors determined by comparing the instantaneous peak level of the input signal with the noise level estimate in said parameter selection block.

11. A noise reduction circuit as claimed in claim 10, wherein said noise reduction block comprises switch gates that select one or more of said incoming signal, the signal level output signal, and the noise level estimate signal with the scaling factors $\alpha$ and $\beta$ set by the parameter selection block applied thereto to generate the noise reduced output signal.

12. A noise reduction circuit as claimed in claim 11, wherein said noise level estimator block comprises:

(a) an accumulator for accumulating the magnitude of the incoming signal over a predetermined number of samples to obtain an updated noise level signal; and (b) a comparator for comparing the updated noise level signal with an incremented previous noise level estimate signal.

13. A noise reduction circuit as claimed in claim 12, wherein $c_1$ is 4, $c_2$ is 2, $c_3$ is 4, $c_4$ is 0.5, and $c_5$ is 2.

14. An echo canceller integrated circuit comprising a noise reduction circuit as claimed in claim 10.

* * * * *